US009464826B2

(12) United States Patent
Tsai

(10) Patent No.: US 9,464,826 B2
(45) Date of Patent: Oct. 11, 2016

(54) HYBRID SYSTEM COMBINING CHILLER AND ABSORPTION HEAT PUMP

(71) Applicant: Jen-Huang Tsai, Taipei (TW)

(72) Inventor: Jen-Huang Tsai, Taipei (TW)

(73) Assignee: Hsiu-Lin Peng, Tainan (TW)

( * ) Notice: Subject to any disclaimer, the term of this patent is extended or adjusted under 35 U.S.C. 154(b) by 707 days.

(21) Appl. No.: 13/940,250

(22) Filed: Jul. 11, 2013

(65) Prior Publication Data

US 2015/0013373 A1 Jan. 15, 2015

(51) Int. Cl.

| | |
|---|---|
| ***F25B 7/00*** | (2006.01) |
| ***F25B 15/00*** | (2006.01) |
| ***F25B 25/00*** | (2006.01) |
| ***F25B 25/02*** | (2006.01) |
| ***F25B 40/02*** | (2006.01) |
| *F25B 15/04* | (2006.01) |
| *F25B 15/06* | (2006.01) |

(52) U.S. Cl.

CPC ..... *F25B 25/02* (2013.01); *F25B 40/02* (2013.01); *F25B 15/04* (2013.01); *F25B 15/06* (2013.01)

(58) Field of Classification Search

CPC .. F25B 15/006; F25B 27/005; F25B 27/007; F25B 2315/007; F25B 25/00; F25B 25/005; F25B 25/02

See application file for complete search history.

(56) References Cited

U.S. PATENT DOCUMENTS

2007/0039349 A1* 2/2007 Yamada ..... F25B 41/00 62/500
2010/0094434 A1* 4/2010 Ballet ..... F25B 1/10 700/28
2011/0048502 A1* 3/2011 Kikinis ..... F24D 11/0221 136/248
2012/0000221 A1* 1/2012 Abdelaziz ..... F25B 15/06 62/112
2013/0061615 A1* 3/2013 Omer ..... F24F 13/222 62/82

FOREIGN PATENT DOCUMENTS

CN 1804511 A * 1/2006
CN 1804511 7/2006

OTHER PUBLICATIONS

"Office Action of China Counterpart Application", issued on Dec. 23, 2015, p. 1-p. 6.

* cited by examiner

*Primary Examiner* — Frantz Jules
*Assistant Examiner* — Erik Mendoza-Wilkenfe
(74) *Attorney, Agent, or Firm* — Jianq Chyun IP Office

(57) ABSTRACT

A hybrid system including an absorption heat pump and a compression chiller is provided. The absorption heat pump includes a generator, a first condenser, a first evaporator and an absorber connected in series. A first refrigerant is cooled by the first condenser and releases a first heat capacity, evaporated in the first evaporator and receives a second heat capacity, and mixed with a sorbent in the absorber and releases a third heat capacity. The compression chiller includes a compressor, a condensing module and a second evaporator connected in series. A second refrigerant is cooled by the condensing module and releases the second heat capacity, and evaporated in the second evaporator and receives a fourth heat capacity, wherein the condensing module is connected to the first evaporator, so that the second heat capacity released by the second refrigerant is transmitted to the first refrigerant in the first evaporator.

11 Claims, 3 Drawing Sheets

HYBRID SYSTEM COMBINING CHILLER AND ABSORPTION HEAT PUMP

TECHNICAL FIELD

The disclosure relates to a hybrid system combining a chiller and an absorption heat pump, to provide high heating efficiency and high cooling efficiency.

BACKGROUND

In recent years, various thermal exchange devices that provide a heating or cooling effect by driving a refrigerant for a refrigeration cycle are developed. A thermal exchange device drives the refrigeration cycle with a heat source or an electrical power. The refrigerant is chilled by a condenser to become in a liquid state, and is evaporated by an evaporator to become in a vapor state. Therefore, a heat capacity is absorbed or released via phase transformation of the refrigerant during operation of the thermal exchange device.

The thermal exchange device may be a cooling device or a heating device, based on practical needs, to provide a function of chilling or heating in a predetermined area. A thermal exchange device when serving as a heating device, it releases a heat capacity for heating. In addition, the thermal exchange device needs to absorb an additional heat capacity from a separate area when releasing the heat capacity for heating. Therefore, the operating cost of the heating device increases. On the other hand, a thermal exchange device when serving as a cooling device, it absorbs a heat capacity for chilling. In addition, the thermal exchange device needs to release a heat capacity to a separate area when absorbing the heat capacity, thus generating waste heat. Consequently, a thermal efficiency of an independently used thermal exchange device is less preferable.

SUMMARY

The disclosure provides a hybrid system that combines a chiller and an absorption heat pump and has preferable heating and cooling efficiencies.

The hybrid system that combines the chiller and the absorption heat pump includes an absorption heat pump and a compression chiller. The absorption heat pump includes a generator, a first condenser, a first evaporator, and an absorber. The generator is configured for driving a first refrigerant and a sorbent mixed with each other with a heat source. The first condenser is connected to the generator, and the first refrigerant is chilled by the first condenser to release a first heat capacity. The first evaporator is connected to the first condenser, and the chilled first refrigerant is evaporated in the first evaporator to absorb a second heat capacity. The absorber is connected between the first evaporator and the generator, the sorbent and the evaporated first refrigerant are respectively transmitted from the generator and the first evaporator to the absorber to be mixed with each other to release a third heat capacity, and the mixed first refrigerant and the sorbent are transmitted to the generator. The compression chiller includes a compressor, a condensing module, an expansion valve, and a second evaporator. The compressor is configured for driving a second refrigerant with an electrical power. The condensing module is connected to the compressor, and the second refrigerant is chilled by the condensing module to release the second heat capacity. The expansion valve is connected to the condensing module, and the chilled second refrigerant is transmitted to the expansion valve. The second evaporator is connected between the expansion valve and the compressor, the second refrigerant is transmitted to the second evaporator via the expansion valve, and the second refrigerant is evaporated in the second evaporator to absorb a fourth heat capacity. The evaporated second refrigerant is transmitted to the compressor, wherein the condensing module of the compression chiller and the first evaporator of the absorption heat pump are connected to each other, and the second heat capacity released by the second refrigerant is transmitted to the first refrigerant in the first evaporator.

Based on the above, in the hybrid system that combines the chiller and the absorption heat pump of the disclosure, the condensing module of the compression chiller and the first evaporator of the absorption heat pump are connected to each other for thermal energy exchange, wherein the second refrigerant is chilled by the condensing module and releases the second heat capacity, the second heat capacity is transmitted to the first refrigerant in the first evaporator, and the first refrigerant is evaporated in the first evaporator to absorb the second heat capacity. The first refrigerant that absorbs the second heat capacity is capable of releasing a larger amount of the first and third heat capacities in the first condenser and the absorber, and the second refrigerant that releases the second heat capacity is capable of absorbing a larger amount of the fourth heat capacity in the second evaporator. Therefore, the hybrid system that combines the chiller and the absorption heat pump of the disclosure has preferable heating and cooling efficiencies.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the application.

DETAILED DESCRIPTION OF DISCLOSED EMBODIMENTS

Figure 1:
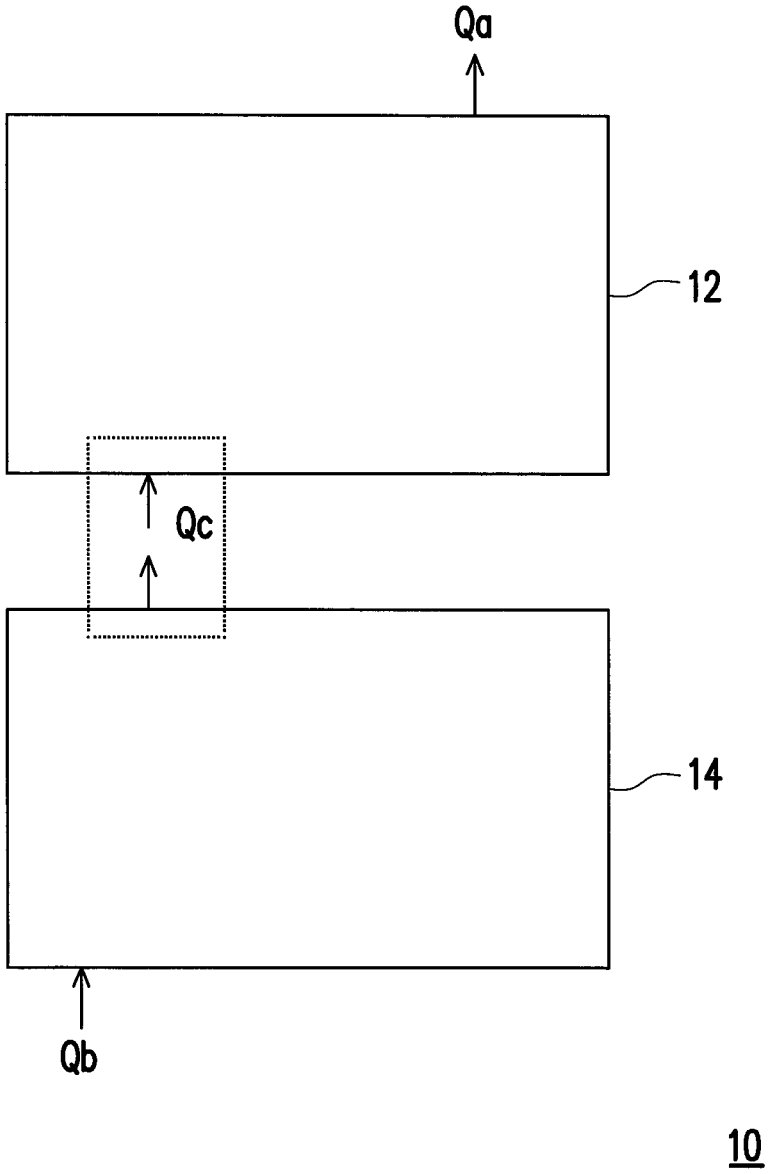
FIG. 1 is a concept illustration of a hybrid system combining a chiller and an absorption heat pump according to an embodiment of the disclosure.

FIG. 1 is a concept illustration of a hybrid system combining a chiller and an absorption heat pump according to an embodiment of the disclosure. Referring to FIG. 1, in this embodiment, a hybrid system 10 that combines a chiller and an absorption heat pump integrates thermal exchange devices 12 and 14. The thermal exchange devices 12 and 14 may absorb or release a heat capacity during operation. Therefore, the thermal exchange devices 12 and 14 may be a cooling device or a heating device based on practical needs and provide a function of chilling or heating in a predetermined area. For example, in FIG. 1, the thermal exchange device 12 serves as a heating device and releases a heat capacity Qa, whereas the thermal exchange device 14 serves as a cooling device and absorbs a heat capacity Qb. When releasing the heat capacity Qa, the thermal exchange device 12 needs to simultaneously absorb an additional heat capacity, whereas the thermal exchange device 14 may also simultaneously release a heat capacity rendered as waste heat when absorbing the heat capacity Qb. Therefore, the hybrid system 10 that combines the chiller and the absorption heat pump integrates the thermal exchange devices 12 and 14. The thermal exchange devices 12 and 14 are connected to each other, such that a heat capacity Qc released by the thermal exchange device 14 may be transferred to and absorbed by the thermal exchange device 12. Therefore, the thermal exchange device 12 does not require an additional heat capacity, and the waste heat generated by the thermal exchange device 14 may also be utilized effectively. In this way, thermal efficiencies of the thermal exchange devices 12 and 14 are improved.

Figure 2:
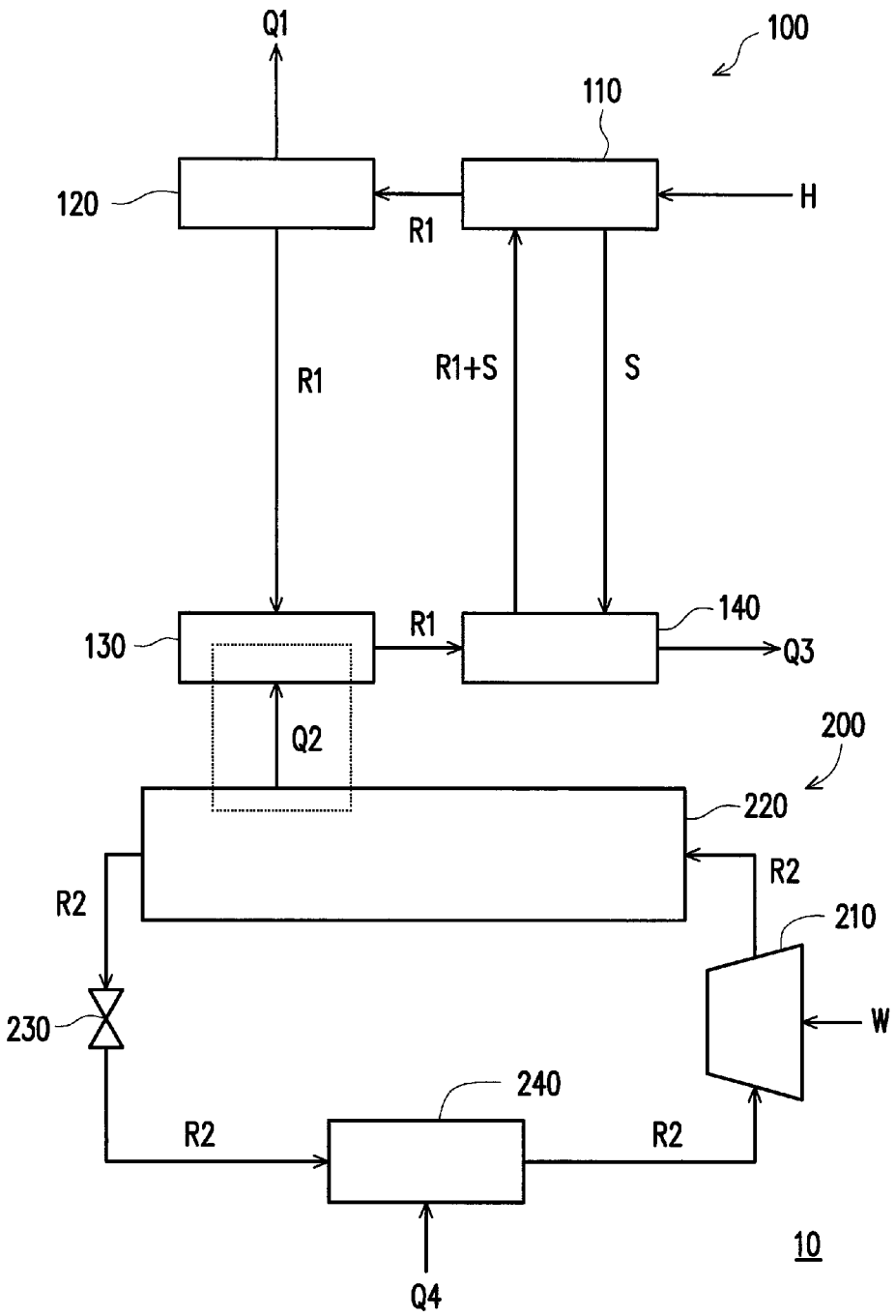
FIG. 2 is a schematic view of a hybrid system combining a chiller and an absorption heat pump according to an embodiment of the disclosure.

FIG. 2 is a schematic view of a hybrid system combining a chiller and an absorption heat pump according to an embodiment of the disclosure. Referring to FIG. 2, in this embodiment, the hybrid system 10 that combines the chiller and absorption heat pump includes an absorption heat pump 100 and a compression chiller 200. In other words, in this embodiment, the absorption heat pump 100 serves as the thermal exchange device 12 of FIG. 1, and the compression chiller 200 serves as the thermal exchange device 14 of FIG. 1. The hybrid system 10 that combines the chiller and absorption heat pump integrates the absorption heat pump 100 and the compression chiller 200, such that the absorption heat pump 100 and the compression chiller 200 are connected to each other for improving thermal efficiencies of the absorption heat pump 100 and the compression chiller 200. Below describes the absorption heat pump 100 and the compression chiller 200 respectively.

In this embodiment, the absorption heat pump 100 includes a generator 110, a first condenser 120, a first evaporator 130, and an absorber 140. The first condenser 120 is connected to the generator 110, the first evaporator 130 is connected to the first condenser 120, and the absorber 140 is connected between the first evaporator 130 and the generator 110. The absorption heat pump 100 transmits a first refrigerant R1 and a sorbent S to the generator 110, the first condenser 120, the first evaporator 130, and the absorber 140 in series to absorb or release a heat capacity.

Specifically, in this embodiment, the generator 110 drives the first refrigerant R1 and the sorbent S mixed with each other with a heat source H. The heat source H of this embodiment is hot water, for example. However, the heat source in other embodiments may be steam, waste heat, or solar energy. The disclosure does not limit on types of the heat source. In addition, the first refrigerant R1 may be water or NH3, the sorbent S may be lithium bromide (LiBr) solution or water, and the first refrigerant R1 and the sorbent are mixed with each other. In this embodiment, given that the first refrigerant R1 is water, a LiBr solution may be chosen as the sorbent S. In other embodiments, the first refrigerant R1 and the sorbent S may be a combination of water and NH3 or mixture of other suitable materials. A temperature of the first refrigerant R1 and the sorbent S mixed to each other in the generator 110 increases due to driving of the heat source H. Then the first refrigerant R1 is transmitted to the first condenser 120. After the first refrigerant R1 is transmitted to the first condenser 120, a concentration of the sorbent S increases, and the sorbent S is transmitted to the absorber 140.

After the first refrigerant R1 is transmitted to the first condenser 120, the temperature of the first refrigerant R1 decreases due to chilling of the first condenser 120, and a first heat capacity Q1 is released. The chilled first refrigerant R1 is transmitted to the first evaporator 130. In the first evaporator 130, the first refrigerant R1 is evaporated and absorbs a second heat capacity Q2. The evaporated first refrigerant R1 becomes vapor and is transmitted to the absorber 140. The sorbent S with the increased concentration and the evaporated first refrigerant R1 are respectively transmitted from the generator 110 and the first evaporator 130 to the absorber 140 to be mixed with each other to release a third heat capacity Q3. By being mixed with the first refrigerant R1, the concentration of the sorbent S decreases and returns to the initial state. After being mixed with each other, the first refrigerant R1 and the sorbent S are transmitted from the absorber 140 to the generator 110, and the operation described above is performed again. In this way, the absorption heat pump 100 releases the first and third heat capacities Q1 and Q3, while absorbs the second heat capacity Q2.

On the other hand, in this embodiment, the compression chiller 200 includes a compressor 210, a condensing module 220, an expansion valve 230, and a second evaporator 240. The condensing module 220 is connected to the compressor 210, the expansion valve 230 is connected to the condensing module 220, and the second evaporator 240 is connected between the expansion valve 230 and the compressor 210. The compression chiller 200 transmits a second refrigerant R2 to the compressor 210, the condensing module 220, the expansion valve 230, and the second evaporator 240 in series, so as to absorb or release a heat capacity.

Specifically, in this embodiment, the compressor 210 drives the second refrigerant R2 with a work W of an electrical power. In this embodiment, the second refrigerant R2 may be an appropriate refrigerant chosen from common refrigerants on the market, such as a R410A or R507A refrigerant. However, in other embodiments, a different kind of refrigerants may also be chosen. A temperature of the second refrigerant R2 increases in the compressor 210 due to driving of the electrical power, and the second refrigerant R2 is transmitted to the condensing module 220. Then, the temperature of the second refrigerant R2 decreases due to chilling of the condensing module 220, and the second heat capacity Q2 is released. The chilled second refrigerant R2 is transmitted to the expansion valve 230, and then transmitted to the second evaporator 240 via the expansion valve 230. The second refrigerant R2 is evaporated in the second evaporator 240 and absorbs a fourth heat capacity Q4. The evaporated second refrigerant R2 is then transmitted to the compressor 210, and the operation described above is performed again. Therefore, the compression chiller 200 releases the second heat capacity Q2 and absorbs the fourth heat capacity Q4.

In this embodiment, the condensing module 220 of the compression chiller 200 and the first evaporator 130 of the absorption heat pump 100 are connected to each other. The second heat capacity Q2 released by the second refrigerant R2 in the condensing module 220 is transmitted to the first refrigerant R1 in the first evaporator 130. Therefore, the first refrigerant R1 may absorb the second heat capacity Q2 released from the condensing module 220 in the first evaporator 130. Based on the description above and the schematic view illustrated in FIG. 2, it can be understood that in the hybrid system 10 that combines the chiller and absorption heat pump, the condensing module 220 of the compression chiller 200 and the first evaporator 130 of the absorption heat pump 110 are connected to each other. The second heat capacity Q2 released by the second refrigerant R2 in the condensing module 220 may be transmitted to the first evaporator 130 and absorbed by the first refrigerant R1 in the first evaporator 130. In this way, an additional heat capacity provided to the first refrigerant R1 in the first evaporator 130 is saved, and the heat capacity generated by the second refrigerant R2 in the condensing module 220 is also used effectively without generating waste heat. Moreover, the thermal efficiencies of the absorption heat pump 100 and the compression chiller 200 are improved. Consequently, the hybrid system 10 that combines the chiller and the absorption heat pump has preferable heating and cooling efficiencies.

Figure 3:
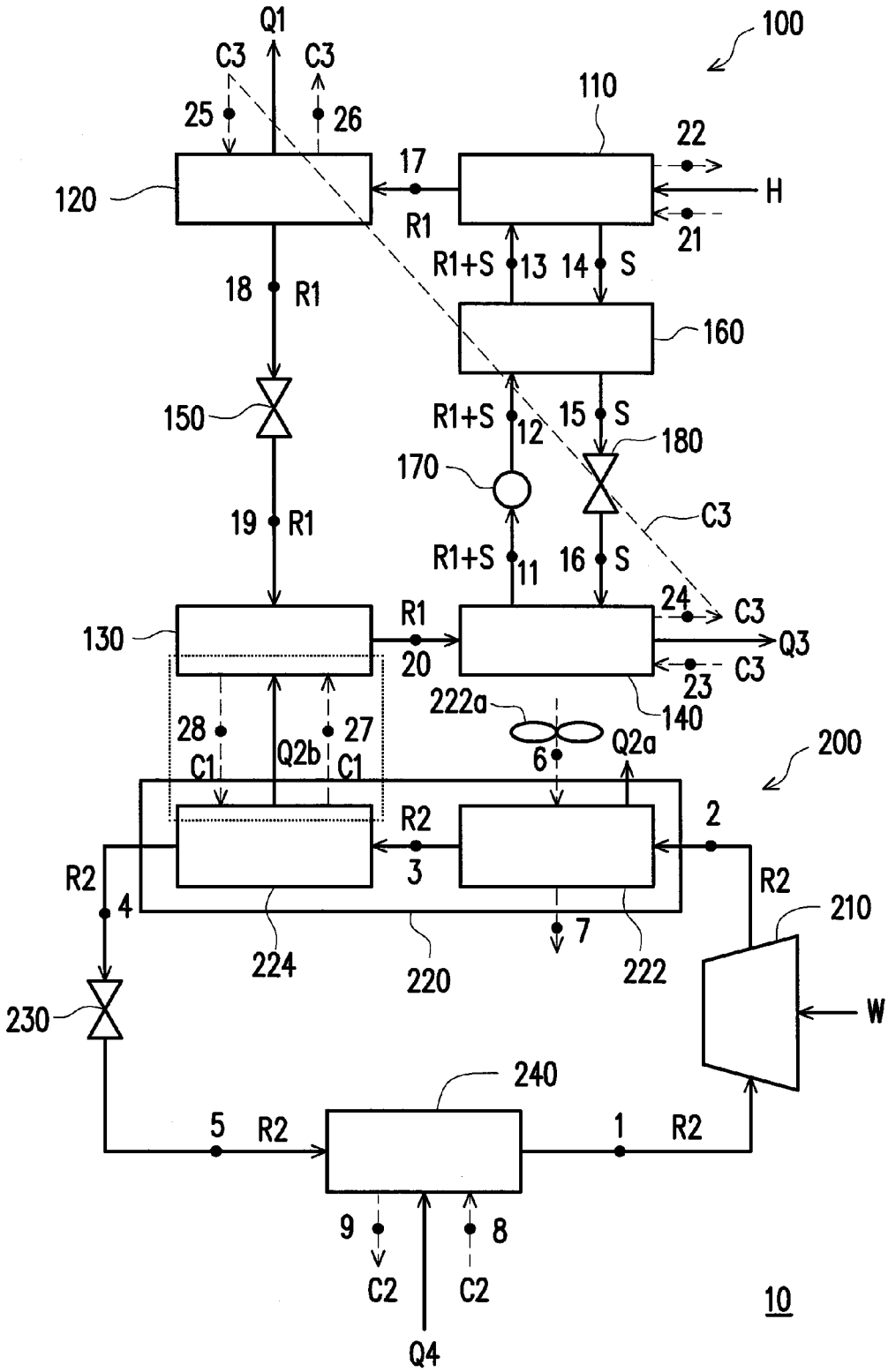
FIG. 3 illustrates an exemplary configuration of the hybrid system combining the chiller and the absorption heat pump of FIG. 2.

FIG. 3 illustrates a structural view of the hybrid system combining the chiller and the absorption heat pump of FIG. 2. Referring to FIGS. 2 and 3, in this embodiment, the condensing module 220 of the compression chiller 200 includes a second condenser 222 and a cooler 224. The second condenser 222 is connected to the compressor 210, the cooler 224 is connected between the second condenser 222 and the expansion valve 230, and the first evaporator 130 of the absorption heat pump 100 is connected with the cooler 224. Therefore, the second refrigerant R2 transmitted from the compressor 210 to the condensing module 220 passes through the second condenser 222 and the cooler 224 in series to release the second heat capacity Q2, and the second heat capacity Q2 is transmitted to the first evaporator 130, such that the first refrigerant R1 in the first evaporator 130 may absorb the second heat capacity Q2.

More specifically, when the second refrigerant R2 passes through the second condenser 222 and the cooler 224 in series, the temperature of the second refrigerant R2 decreases in the second condenser 222 and the cooler 224 in series and releases a partial second heat capacity Q2*a* and a partial second heat capacity Q2*b* in series, wherein a sum of the partial second heat capacities Q2*a* and Q2*b* are the second heat capacity Q2 released by the second refrigerant R2 in the condensing module 220. In this embodiment, since the first evaporator 130 is connected with the cooler 224, the partial second heat capacity Q2*b* released by the second refrigerant R2 in the cooler 224 is transmitted to the first refrigerant R1 in the first evaporator 130, and the partial second heat capacity Q2*a* released by the second refrigerant R2 in the second condenser 222 is dissipated to an external environment. However, the disclosure is not limited thereto. In other embodiments, the first evaporator 130 may be simultaneously connected with the second condenser 222 and the cooler 224, such that the second heat capacity Q2 released by the second refrigerant R2 in the condensing module 220, including the partial second heat capacity Q2*a* released by the second refrigerant R2 in the second condenser 222 and the partial second heat capacity Q2*b* released in the cooler 224, is transmitted to the first refrigerant R1 in the first evaporator 130. In this way, the first refrigerant R1 may absorb the second heat capacity Q2 in the first evaporator 130. Specific embodiments of the first refrigerant R1 and the second refrigerant R2 absorbing or releasing the heat capacity in the absorption heat pump 100 and the compression chiller 200 are described below respectively.

In this embodiment, the second condenser 222 of the condensing module 220 includes a fan 222*a* for chilling the second refrigerant R2. The partial second heat capacity Q2*a* released by the second refrigerant R2 in the second condenser 222 is dissipated to the external environment with an airflow provided by the fan 222*a*. Besides, the cooler 224 chills the second refrigerant R2 with chilled water C1 flowed from the first evaporator 130, thereby releasing the partial second heat capacity Q2*b* and using the chilled water C1 to transmit the partial second heat capacity Q2*b* to the first refrigerant R1 of the first evaporator 130. More specifically, the chilled water C1 provides the partial second heat capacity Q2*b* to the first refrigerant R1 in the first evaporator 130, and the flows into the cooler 224. A temperature of the chilled water C1 decreases after providing the partial second heat capacity Q2*b*, thereby being used to chill the second refrigerant R2 in the cooler 224. The temperature of the second refrigerant R2 decreases after the second refrigerant R2 is chilled by the second condenser 222 and the cooler 224 in series, allowing the second refrigerant R2 to absorb a larger amount of the fourth heat capacity Q4 in the second evaporator 240. In this way, the cooling efficiency of the compression chiller 200 is improved.

Furthermore, after being chilled by the chilled water C1, the second refrigerant R2 releases the partial second heat capacity Q2*b* to the chilled water C1. Therefore, when the chilled water C1 flows back to the first evaporator 130 from the cooler 224, the chilled water C1 carries the partial second heat capacity Q2*b* to the first evaporator 130 to provide the partial second heat capacity Q2*b* to the first refrigerant R1. After providing the partial second heat capacity Q2*b* to the first refrigerant R1, the chilled water C1 flows into the cooler 224 to chill the second refrigerant R2. Thus, it can be understood that the first refrigerant R1 may be evaporated in the first evaporator 130 with the partial second heat capacity Q2*b* brought by the chilled water C1. Therefore, the first evaporator 130 of the absorption heat pump 100 does not require an additional heat capacity, and the partial second heat capacity Q2*b* generated by the cooler 224 of the compression chiller 200 may also be utilized effectively, preventing the partial second heat capacity Q2*b* from becoming waste heat.

Compared to the absorption heat pump 100 of this embodiment, a conventional absorption heat pump is not connected to a compression chiller. The chilled water in the first evaporator of the conventional absorption heat pump is not flowed into the cooler 224 to absorb the partial heat capacity Q2*b*. Therefore, the heat capacity provided to the first refrigerant R1 by the chilled water in the first evaporator becomes less. On the contrary, in this embodiment, since the chilled water C1 absorbs the partial second heat capacity Q2*b* released by the second refrigerant R2 in the cooler 224, the first refrigerant R1 is allowed to absorb a larger amount of heat in the first evaporator 130 and release a larger amount of the first heat capacity Q1 and the third heat capacity Q3 in the first condenser 120 and the absorber 140, thereby improving the heating efficiency of the absorption heat pump 100. Therefore, the thermal efficiencies of the absorption heat pump 100 and the compression chiller 200 are improved, making the heating and cooling efficiencies of the hybrid system 10 that combines the chiller and the absorption heat pump preferable.

Moreover, in this embodiment, chilled water C2 flows into the second evaporator 240 to provide the fourth heat capacity Q4 to the second refrigerant R2 in the second evaporator 240. A temperature of the chilled water C2 decreases after providing the fourth heat capacity Q4, and the chilled water C2 flows out of the second evaporator 240. The compression chiller 200 has a cooling effect with the second refrigerant R2 absorbing the fourth heat capacity Q4 in the second evaporator 240. The compression chiller 200 may serve as an air-conditioning device (e.g. an air-conditioner for home use or a central air-conditioning system) or a refrigerating device (e.g. a refrigerator for home use or a refrigerated storeroom). Since the second refrigerant R2 releases a larger amount of the second heat capacity R2 in the condensing module 222, the second refrigerant R2 absorbs a larger amount of the fourth heat capacity Q4 in the second evaporator 240. In this way, the cooling efficiency of the compression chiller 200 is improved.

In addition, in this embodiment, cooling water C3 passes through the absorber 140 and the first condenser 120 in series for absorbing the first heat capacity Q1 released by the first condenser 120 and the third heat capacity Q3 released by the absorber 140. The cooling water C3 flows through the absorber 140 and the first condenser 120 via pipes, for example, and is applied for heating after absorbing the first and third heat capacities Q1 and Q3. In this embodiment, the pipes for the cooling water C3 are connected in series with each other, such that the cooling water C3 absorbs the third heat capacity Q3 and the first heat capacity Q1 in series. It can be understood that the cooling water C3 is heated by the first and third heat capacities Q1 and Q3 released by the absorption heat pump 100, and is applied to a domestic or commercial usage that requires heating, such as hot water required for bathing or cooking. However, in other embodiments, the pipes used by the cooling water C3 may be disposed in parallel, such that the cooling water C3 may separately pass through the absorber 140 and the first condenser 120. The cooling water C3 separately absorbs the third heat capacity Q3 and the first heat capacity Q1 for uses for different purposes. For example, one of the heat capacities may be used for bathing, and the other may be used for cooking.

Moreover, in this embodiment, the absorption heat pump 100 further includes an expansion valve 150. The expansion valve 150 is disposed between the first condenser 120 and the first evaporator 130. The first refrigerant R1 is chilled in the first condenser 120, then transmitted to the expansion valve 150, and further transmitted to the first evaporator 130 via the expansion valve 150. In addition, the absorption heat pump 100 further includes a heat exchanger 160, an absorbent pump 170, and an expansion valve 180. The heat exchanger 160 is disposed between the generator 110 and the absorber 140, and the absorbent pump 170 and the expansion valve 180 are respectively connected between the absorber 140 and the heat exchanger 160. Therefore, when the first refrigerant R1 and the sorbent S are driven by the heat source H in the generator 110, the sorbent S is transmitted to the heat exchanger 160 for heat exchange, and is transmitted to the absorber 140 from the heat exchanger 160 via the expansion valve 180, so as to be mixed with the first refrigerant R1 in the absorber 140. After being mixed with each other, the first refrigerant R1 and the sorbent S are transmitted from the absorber 140 to the heat exchanger 160 via the absorbent pump 170 for heat exchange, and are transmitted from the heat exchanger 160 back to the generator 110.

It can be understood from the description above that the absorption heat pump 100 simultaneously provide the chilling and heating effects, wherein the first condenser 120 and the absorber 140 of the absorption heat pump 100 release the first and third heat capacities Q1 and Q3 for heating the cooling water C3, whereas the first evaporator 130 of the absorption heat pump 100 absorbs the second heat capacity Q2 to chill the chilled water C1 and make chilled water C1 after being chilled chill the second refrigerant R2 in the cooler 224. The compression chiller 200 provides a cooling effect, wherein the second evaporator 240 of the compression chiller 200 absorbs the fourth heat capacity Q4 to chill the chilled water C2. In addition, the second heat capacity Q2 released by the condensing module 220 of the compression chiller 200 is transmitted to the first evaporator 130 of the absorption heat pump 100 to prevent generation of waste heat. Therefore, the hybrid system 10 that combines the chiller and the absorption heat pump has preferable heating and cooling efficiencies.

The thermal efficiencies above are the heating efficiency of the absorption heat pump 100 or the cooling efficiency of the compression chiller 200. The efficiencies may be represented by a coefficient of performance (COP). The compression chiller 200 provides a cooling effect in the hybrid system 10 that combines the chiller and the absorption heat pump. Therefore, a COP of the compression chiller 200 is represented in the following formula:

$$COP = \frac{\text{(Cooling capacity)}}{\text{(Power input)}} = \frac{Q4}{W}$$

It can be understood that the COP of the compression chiller 200 is a ratio of the fourth heat capacity Q4 absorbed by the second refrigerant R2 relative to the work W of the electrical power for driving the second refrigerant R2. Therefore, the cooling effect of the compression chiller 200 is better as the COP of the compression chiller 200 becomes higher.

On the other hand, the absorption heat pump 100 provides cooling (for chilling the second refrigerant R2 in the cooler 224 in the compression chiller 200) and heating effects in the hybrid system 10 that combines the chiller and the absorption heat pump. Therefore, the heating and cooling effects of the absorption heat pump 100 may be represented with two COPs, as the formulas in the following:

$$COP_{Cooling} = \frac{\text{(Cooling capacity)}}{\text{(Thermal power input)}} = \frac{Q2b}{H}$$

$$COP_{Heating} = \frac{\text{(Total heating capacity)}}{\text{(Thermal power input)}} = \frac{Q1 + Q3}{H}$$

It can be understood that a COP ($COP_{Cooling}$) of the cooling effect of the absorption heat pump 100 is a ratio of the partial second heat capacity Q2*b* absorbed by the first refrigerant R1 relative to thermal energy provided by the heat source H for driving the first refrigerant R1, whereas a COP ($COP_{Heating}$) of the heating effect of the absorption heat pump 100 is a ratio of the first and third heat capacities Q1 and Q3 relative to the thermal energy provided by the heat source H for driving the first refrigerant R1. Therefore, both the cooling and heating effects of the absorption heat pump 100 are better if the COPs of the absorption heat pump 100 are higher.

A simulation for the hybrid system 10 that combines the chiller and the absorption heat pump is performed and illustrated in FIG. 3. Input parameters, characteristic parameters, and performance results are shown in the following table.

| Input Parameters | | | | | |
|---|---|---|---|---|---|
| m[1] | 0.5 | T[6] | 25 | m[6] | 2 |
| T[9] | 5 | m[9] | 2 | m[11] | 0.05 |
| T[21] | 100 | m[21] | 1 | T[23] | 25 |
| m[23] | 0.28 | m[27] | 0.4 | $Eff_{evap_2}$ | 0.8 |
| $Eff_{cond_2}$ | 0.8 | $Eff_{cooler}$ | 0.8 | $Eff_{shx}$ | 0.64 |
| $Eff_{generator}$ | 0.15 | $Eff_{absorber}$ | 0.78 | $Eff_{cond_1}$ | 0.64 |
| $Eff_{evap_1}$ | 0.74 | | | | |

-continued

| Characteristic Parameters | | | | | | |
|---|---|---|---|---|---|---|
| | h[i] | m[i] | P[i] | s[i] | T[i] | x[i] |
| 1 | 215.40 | 0.50 | 692.30 | 0.80 | 3.11 | |
| 2 | 236.40 | 0.50 | 2071.00 | 0.80 | 48.08 | |
| 3 | 117.00 | 0.50 | 2071.00 | 0.42 | 44.24 | |
| 4 | 87.07 | 0.50 | 2071.00 | 0.32 | 24.88 | |
| 5 | 87.07 | 0.50 | 692.30 | 0.33 | 3.11 | |
| 6 | 1299.00 | 2.00 | 101.30 | | 25.00 | |
| 7 | 1329.00 | 2.00 | 101.30 | | 40.39 | |
| 8 | 53.09 | 2.00 | | | 12.65 | |
| 9 | 21.02 | 2.00 | | | 5.00 | |
| 11 | 55.90 | 0.05 | 2.18 | | 26.11 | 0.35 |
| 12 | 55.92 | 0.05 | 20.97 | | 26.11 | 0.35 |
| 13 | 123.80 | 0.05 | 20.97 | | 51.67 | 0.35 |
| 14 | 173.10 | 0.04 | 20.97 | | 75.08 | 0.40 |
| 15 | 94.91 | 0.04 | 20.97 | | 43.74 | 0.40 |
| 16 | 94.91 | 0.04 | 2.18 | | 30.03 | 0.40 |
| 17 | 2629.00 | 0.01 | 20.97 | | 70.64 | |
| 18 | 255.80 | 0.01 | 20.97 | | 61.10 | |
| 19 | 255.80 | 0.01 | 2.18 | | 18.90 | |
| 20 | 2535.00 | 0.01 | 2.18 | | 18.90 | |
| 21 | 419.10 | 1.00 | | | 100.00 | |
| 22 | 400.50 | 1.00 | | | 95.60 | |
| 23 | 104.80 | 0.28 | | | 25.00 | |
| 24 | 168.90 | 0.28 | | | 40.33 | |
| 25 | 168.90 | 0.28 | | | 40.33 | |
| 26 | 224.50 | 0.28 | | | 53.62 | |
| 27 | 129.70 | 0.40 | | | 30.97 | |
| 28 | 92.35 | 0.40 | | | 22.04 | |

| Performance Results | | | |
|---|---|---|---|
| Electrical power input | 10.52 kW | Cooling capacity | 64.14 kW |
| Thermal energy input | 18.57 kW | Heating capacity | 33.53 kW |
| $COP_{Cooling}$ | 6.09 | $COP_{Cooling}$ | 1.81 |

In the table, "h" represents enthalpy (measuring unit: kJ/kg), "m" represents flow rate (measuring unit: kg/s), "T" represents temperature (measuring unit: ° C.), "P" represents pressure (measuring unit: kPa), "s" represents entropy (measuring unit: kJ/kg° C.), "x" represents ratio of concentration (a ratio value of the weight of the sorbent S relative to the weight of the first refrigerant R1 and the sorbent S in total, no measuring unit therefor), and Eff in the input parameters (e.g. $Eff_{generator}$ or $Eff_{absorber}$) represents an operating efficiency of each element. The input and characteristic parameters are parameter values of points (shown in FIG. 3) in the hybrid system 10 that combines the chiller and the absorption heat pump.

As shown in Table 1, the work W of the electrical power received by the compressor 210 of the compression chiller 200 is 10.52 kW, and the fourth heat capacity Q4 absorbed by the second refrigerant R2 in the second evaporator 240 is 64.14 kW. Based on the formula above, it is known that the COP of the compression chiller 200 is about 6.09. Similarly, the thermal energy provided by the heat source H and received by the generator 110 of the absorption heat pump 100 is 18.57 kW, whereas a total of the first heat capacity Q1 and the third heat capacity Q3 released by the first refrigerant R1 in the first condenser 120 and the absorber 140 is 33.53 kW. Therefore, based on the formula above, it is known that the COP of the absorption heat pump 100 is about 1.81.

A conventional independently used compression chiller usually chills the second refrigerant R2 with a condenser. Therefore, a COP of the conventional compression chiller is about 4.75 (input work: 10.39 kW, absorbed heat capacity: 49.3 kW). Compared with the conventional compression chiller, the compression chiller 200 of this embodiment further uses the chilled water C1 released by the first evaporator 130 of the absorption heat pump 100 to chill the second refrigerant R2 in the cooler 224, thereby allowing the second refrigerant R2 to release a larger amount of the second heat capacity Q2 in the condensing module 220 and absorb a larger amount the fourth heat capacity Q4 in the second evaporator 240. Therefore, the COP of the compression chiller 220 of this embodiment is about 6.09, higher than the conventional compression chiller.

Moreover, a conventional independently used absorption heat pump provide a heat capacity to the first refrigerant with chilled water at the evaporator 130, but the chilled water does not carry the partial second heat capacity Q2*b* from the cooler 224. A COP of a heating effect of the conventional absorption heat pump is about 1.7 (input work: 12.94 kW, released heat capacity: 21.99 kW), and a COP of a cooling effect is about 0.7 (input work: 12.94 kW, absorbed heat capacity: 9.05 kW). As shown above, although the conventional absorption heat pump has the heating and cooling effect at the same time, the COP of the cooling effect is lower. Therefore, the conventional absorption heat pump usually serves as a heating device. Compared to the conventional absorption heat pump, the absorption heat pump 100 of this embodiment uses the chilled water C1 to carry the partial second heat capacity Q2*b* to provide a heat capacity in the evaporator 130, such that the first refrigerant R1 is capable of absorbing a larger amount of heat capacity. Therefore, the COP of the heating effect of the absorption heat pump 100 in this embodiment is about 1.81, higher than the conventional absorption heat pump. In addition, the cooling effect provided by the absorption heat pump 100 may be used to chill the second refrigerant R2. In this way, thermal energy is effectively used.

It can thus be understood that the hybrid system 10 that combines the chiller and the absorption heat pump is capable of increasing the thermal efficiencies of the absorption heat pump 100 and the compression chiller 200. Moreover, after the second refrigerant R2 is chilled by the chilled water C1 flowed from the first evaporator 130, the partial second heat capacity Q2*b* is brought back to the first evaporator 130 by the chilled water C1. Consequently, the first evaporator 130 of the absorption heat pump 100 does not require an additional heat capacity, and the partial second heat capacity Q2*b* generated after the compression chiller 200 chills the second refrigerant R2 is prevented from becoming waste heat. Therefore, the hybrid system 10 that combines the chiller and the absorption heat pump has preferable heating and cooling efficiencies.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A hybrid system combining a chiller and an absorption heat pump, comprising:

an absorption heat pump, comprising:

a generator, driving a first refrigerant and a sorbent mixed with each other with a heat source;

a first condenser, connected to the generator, the first refrigerant being chilled by the first condenser and releasing a first heat capacity;

a first evaporator, connected to the first condenser, the chilled first refrigerant being evaporated in the first evaporator and absorbing a second heat capacity; and an absorber, connected between the first evaporator and the generator, the sorbent and the evaporated first refrigerant being respectively transmitted from the generator and the first evaporator to the absorber to be mixed with each other and release a third heat capacity, and the mixed first refrigerant and the sorbent being transmitted to the generator; and a compression chiller, comprising:

a compressor, driving a second refrigerant with an electrical power;

a condensing module, comprising a second condenser and a cooler, the second condenser being connected to the compressor, the cooler being connected to the second condenser, and the second refrigerant being chilled by the condensing module while passing through the second condenser and the cooler in series and releasing the second heat capacity;

an expansion valve, connected to the cooler of the condensing module, the chilled second refrigerant being transmitted to the expansion valve; and a second evaporator, connected between the expansion valve and the compressor, the second refrigerant being transmitted to the second evaporator via the expansion valve, the second refrigerant being evaporated in the second evaporator and absorbing a fourth heat capacity, and the evaporated second refrigerant being transmitted to the compressor, wherein the cooler of the condensing module of the compression chiller and the first evaporator of the absorption heat pump are connected to each other, and the second heat capacity released by the second refrigerant in the condensing module is transmitted to the first refrigerant in the first evaporator, such that the first refrigerant in the first evaporator absorbs the second heat capacity.

2. The hybrid system combining the chiller and the absorption heat pump as claimed in claim 1, wherein the second condenser of the condensing module comprises a fan for chilling the second refrigerant.

3. The hybrid system combining the chiller and the absorption heat pump as claimed in claim 1, wherein a chilled water in the first evaporator provides the second heat capacity to the first refrigerant and then flows into the cooler, the second refrigerant in the cooler releases the second heat capacity to the chilled water, and the chilled water flows back to the first evaporator to provide the second heat capacity to the first refrigerant.

4. The hybrid system combining the chiller and the absorption heat pump as claimed in claim 1, wherein another chilled water flows into the second evaporator to provide the fourth heat capacity to the second refrigerant in the second evaporator.

5. The hybrid system combining the chiller and the absorption heat pump as claimed in claim 1, wherein a cooling water passes through the absorber and the first condenser in series to absorb the first and third heat capacities.

6. The hybrid system combining the chiller and the absorption heat pump as claimed in claim 1, wherein the absorption heat pump further comprises an expansion valve disposed between the first condenser and the first evaporator.

7. The hybrid system combining the chiller and the absorption heat pump as claimed in claim 1, wherein the absorption heat pump further comprises a heat exchanger disposed between the generator and the absorber.

8. The hybrid system combining the chiller and the absorption heat pump as claimed in claim 7, wherein the absorption heat pump further comprises an absorbent pump connected between the absorber and the heat exchanger, the mixed first refrigerant and the sorbent being transmitted from the absorber to the heat exchanger via the absorbent pump.

9. The hybrid system combining the chiller and the absorption heat pump as claimed in claim 7, wherein the absorption heat pump further comprises an expansion valve connected between the absorber and the heat exchanger, the sorbent being transmitted from the heat exchanger to the absorber via the expansion valve.

10. The hybrid system combining the chiller and the absorption heat pump as claimed in claim 1, wherein the heat source comprises hot water, steam, waste heat, or solar energy.

11. The hybrid system combining the chiller and the absorption heat pump as claimed in claim 1, wherein the first refrigerant comprises water or NH3, the sorbent comprises a lithium bromide (LiBr) solution or water, and the second refrigerant comprises a R410A refrigerant or a R507A refrigerant.

* * * * *